US005129660A

United States Patent [19]

Taylor et al.

[11] Patent Number: 5,129,660

[45] Date of Patent: Jul. 14, 1992

[54] SEAL ASSEMBLY FOR A WELL HOUSING HANGER STRUCTURE

[75] Inventors: William M. Taylor; James A. Burton, both of Houston, Tex.

[73] Assignee: Cooper Industries, Inc., Houston, Tex.

[21] Appl. No.: 660,638

[22] Filed: Feb. 25, 1991

[51] Int. Cl.[5] ..... E21B 33/03

[52] U.S. Cl. ..... 277/117; 277/116.6; 277/236; 166/196; 166/202

[58] Field of Search ..... 277/117, 118, 116.6, 277/102, 12, 116.2, 116.8, 236; 285/917, 24, 27; 166/196, 202

[56] References Cited

U.S. PATENT DOCUMENTS

| | | | |
|---|---|---|---|
| 2,606,618 | 8/1952 | Page | 166/196 |
| 2,767,795 | 10/1956 | Bush | 166/202 |
| 3,273,646 | 9/1966 | Walker | 166/86 |
| 3,389,917 | 6/1968 | McGill | 166/202 |
| 3,404,736 | 10/1968 | Nelson et al. | 166/85 |
| 3,422,902 | 1/1969 | Bouchillon | 166/202 |
| 3,747,963 | 7/1973 | Shivak | 277/236 X |
| 3,797,864 | 3/1974 | Hynes et al. | 285/140 |
| 4,131,287 | 12/1978 | Gunderson et al. | 277/191 |
| 4,477,087 | 10/1984 | Sutter, Jr. et al. | 277/236 X |
| 4,477,093 | 10/1984 | Adamek | 277/236 X |
| 4,496,162 | 1/1985 | McEver et al. | 277/9.5 |
| 4,521,040 | 6/1985 | Slyker et al. | 285/140 |
| 4,572,515 | 2/1986 | Grazioli | 277/12 |
| 4,588,030 | 5/1986 | Blizzard | 166/120 |
| 4,615,544 | 10/1986 | Baugh | 285/18 |
| 4,665,979 | 5/1987 | Boehm, Jr. | 166/208 |
| 4,691,780 | 9/1987 | Galle, Jr. et al. | 166/348 |
| 4,742,874 | 5/1988 | Gullion | 166/348 |
| 4,747,606 | 5/1987 | Jennings | 277/182 |
| 4,749,047 | 6/1988 | Taylor | 166/382 |
| 4,757,860 | 7/1988 | Reimert | 277/117 X |
| 4,766,956 | 8/1988 | Smith et al. | 277/117 X |
| 4,771,828 | 9/1988 | Cassity | 166/115 |
| 4,771,832 | 9/1988 | Bridges | 166/380 |
| 4,790,572 | 12/1988 | Slyker | 285/140 |
| 4,815,770 | 3/1989 | Hyne et al. | 285/140 |
| 4,823,871 | 4/1989 | McEver et al. | 166/182 |
| 4,832,125 | 5/1989 | Taylor | 166/348 |
| 4,911,245 | 3/1990 | Adamek et al. | 166/387 |
| 5,038,865 | 8/1991 | Taylor et al. | 166/182 X |

FOREIGN PATENT DOCUMENTS 0044138 3/1980 Japan .

*Primary Examiner*—William A. Cuchlinski, Jr.
*Assistant Examiner*—James K. Folker

[57] ABSTRACT

The present invention relates to an improved seal assembly for sealing between the interior sealing surface of a well housing and the exterior sealing surface of a hanger landed within the well housing and includes a seal body having a pair of outer lips diverging outwardly for sealing against the housing interior sealing surface and an interior series of annular ridges which have a diameter smaller than the outer diameter of the hanger exterior sealing surface, an upper energizer and a lower energizer for coacting with said lips to move the lips into sealing position and to store the energy of setting to ensure sealing engagement of the lips. The shape of the sealing lips is such that they each provide a sealing surface and a ridge having a greater outer diameter than the sealing surface so that when the seal assembly is being run into the housing any scratches resulting from the engagement of the seal with the interior of the housing is on the ridges and not on the sealing surfaces. Additionally, the exterior of the outwardly diverging lips is provided with a coating of a scratch healing material, such as silver plate, so that scratches on the sealing surface can be healed when the sealing surface is wedged into sealing engagement with the interior wall of the housing.

14 Claims, 6 Drawing Sheets

SEAL ASSEMBLY FOR A WELL HOUSING HANGER STRUCTURE

BACKGROUND

The present invention relates to an improved wellhead structure which is particularly adapted to subsea wells. Such structure includes a wellhead housing and an improved hanger and seal assembly which can be landed and set in a single trip. Prior to the present invention many efforts have been made to provide a satisfactory hanger and seal assembly which allows the landing of the hanger, cementing and the setting of the seal in the annulus between the exterior of the hanger and the interior of the housing.

A similar structure is disclosed in a prior co-pending application entitled Casing Hanger Seal Assembly, filed Aug. 24, 1990 and assigned Ser. No. 07/573 630. This application discloses a similar structure including a seal for the annulus which has two outer diverging lips for sealing against the facing interior surface and the same internal structure and setting structure as is disclosed in the present application. The assignee of the present application is also the assignee of such prior application thus establishing common ownership. The prior application did not provide adequate means for the protection of the sealing surfaces on the sealing lips from scratches or other damage during the running of the assembly into the well housing.

The R. W. Walker U.S. Pat. No. 3,273,646 discloses a hanger and seal assembly in which a snap ring is used to engage within a groove within the interior of the housing and the seal is run in the annulus above a port which allows the circulation of cement to proceed before the seal is set responsive to rotation of the setting sleeve to force the seal downward below the port and to land on shoulder against which it is compressed axially to cause it to expand radially and seal across the annulus.

The B. H. Nelson et al U.S. Pat. No. 3,404,736 discloses an annulus seal in which the seal is positioned within the annulus and held in unset position by a shear pin. The rotation of the setting sleeve causes the pin to shear and the seal and wedge ring to move downward to set the holddown ring and to compress the resilient seal into sealing engagement with the walls of the annulus The J. H. Hynes et al U.S. Pat. No. 3,797,864 discloses another annulus seal which is set by rotation to compress the seal axially. This seal assembly includes end rings with marginal lips which engage the end of the elastomeric seal and when the seal is compressed the lips are deformed into metal-to-metal sealing engagement with the walls of the annulus. The Slyker et al U.S. Pat. No. 4,521,040 discloses a modification of the Hynes et al structure.

Another hanger seal which is set by threading a nut on external threads of the hanger includes a seal body having a plurality of outer metal fins extending outwardly and downwardly and having elastomeric material between the fins, a plurality of inner metal fins extending radially inward and having elastomeric material between the fins and a connection between the seal body and a lower body having an upstanding rim which when the bodies are forced together sets the outer seal legs. Another hanger nut thread set seal includes both inner and outer seal legs which diverge and are loaded by inner and outer rims on the upper body and lower body to set all four seal legs into sealing engagement with the walls of the housing-hanger annulus.

Other prior patents have utilized metal end caps for an elastomeric annulus so that on setting of the seal by compression, the lips of the end caps engage the walls of the annulus to both seal and also protect against the extrusion of the elastomeric material. An example of such structure can be seen in the U.S. Pat. No. 4,496,162 to McEver et al (movement of the seal ring onto enlarged diameter portion of hanger sets the seal ring into sealed position).

The B. F. Baugh U.S. Pat. No. 4,615,544 discloses another type of annulus seal which is set by rotation of a setting sleeve. The seal includes a Z-shaped portion having a plurality of frustoconical metal rings positively connected by links and the grooves formed by the rings being filled with resilient elastomeric members. The seal is set by axial compression which forces the inner and outer ends of the rings and the resilient members into sealing engagement with the walls of the annulus to be sealed.

U.S. Pat. No. 4,572,515 to A. J. Grazoli discloses a seal for sealing between the walls of a seat ring and body in a ball valve. The seal is a ring of polytetrafluoroethylene which includes spaced apart, outwardly diverging sealing lips for sealing against the wall of the body and outwardly diverging sealing lips for sealing against the wall of the seat ring.

Another prior structure is shown in U.S. Pat. No. 4,823,871 wherein the seal assembly included outer lips flaring outwardly from the seal body and having a resilient member between such lips and inner lips which flare inwardly and towards each other with a resilient member between such inner lips. The seal assembly includes structure which exerts a force on at least one of the outer lips to urge it outwardly about its base connection of the seal body into tight sealing engagement with the interior of the housing. The inner lips have a free diameter which is less than the outer sealing surface of the hanger against which they are to seal and thus the movement of these inner lips onto the hanger sealing surface brings them into sealing engagement with the hanger sealing surface.

U.S. Pat. No. 4,911,245 discloses a metal seal for well casing which includes a series of annular ribs with recesses between each of the ribs and an inlay material in the recesses. The ribs are soft to deform when the seal is pressed into contact with the casing and deform to a point flush with the inlay material Subsequent movement between the seal and the casing cause the inlay material to wipe across the rib faces to maintain the seal.

SUMMARY

The improved structure of the present invention relates to an improved hanger seal assembly for sealing between a hanger and a well housing. The hanger is landed within the well housing before the seal assembly is moved into sealing position between the housing and the hanger. The seal assembly is lowered into sealing position between an external hanger sealing surface which is defined on the interior of the well housing and is spaced from the internal housing sealing surface and includes a seal body having external metal sealing lips diverging outward but having an initial free diameter less than the diameter of the housing internal sealing surface and internal metal sealing surfaces on the inner surface of the seal body having a free diameter smaller than the diameter of the hanger external sealing surface, a lower energizer ring movably connected to the seal body and having an upstanding rim which stores the force created by its engaging and moving the lower outer sealing lip to its set position, an upper energizer ring movably connected to the seal body and having a depending rim which stores the force created by its engaging and moving the upper lip to its set position. The lower outer sealing lip includes a first lower sealing surface and a second protecting surface spaced thereabove. The upper sealing lip is the mirror image of the lower sealing lip and includes a first outer sealing surface and a second protecting surface spaced thereabove. During running the second protecting surfaces have larger diameters than the first sealing surfaces so that if the sealing lip comes into contact with the housing through which it is passing the first sealing surfaces do not come into contact with the inner surface of the housing and are thereby protected against scratches and other damage during running. When the sealing lips are moved into set position the first sealing surfaces are moved into sealing engagement with the inner surface of the surrounding housing. Additionally, the surfaces of the lips which may come into contact with the interior of the housing are provided with a coating of a soft, scratch healing material, such as silver plating. The interior projections which provide the interior sealing are spaced along the interior of the seal body by recesses which are either sufficiently deep to avoid problems with liquids trapped therein during setting or have a liquid exclusion material therein. Means for securing or locking the seal assembly and the energizer rings in their set position is included and such securing means includes means for engaging within grooves on the exterior of the hanger and on the interior of the housing. In all forms of the invention there is provided some means for storing the force of the lip setting force and this may include the storing of both axial and radial forces generated for setting the sealing lips.

An object of the present invention is to provide an improved hanger seal assembly for use within a wellhead housing with improved metal-to-metal sealing against the inner and outer surfaces of the hanger-housing annulus and which protects the seal assembly sealing surfaces from damage during running.

Another object is to provide an improved hanger seal assembly of the type described in which slight scratches on the outer sealing lips does not interfere with their ability to seal against the interior of the housing.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENT

Figure 1:
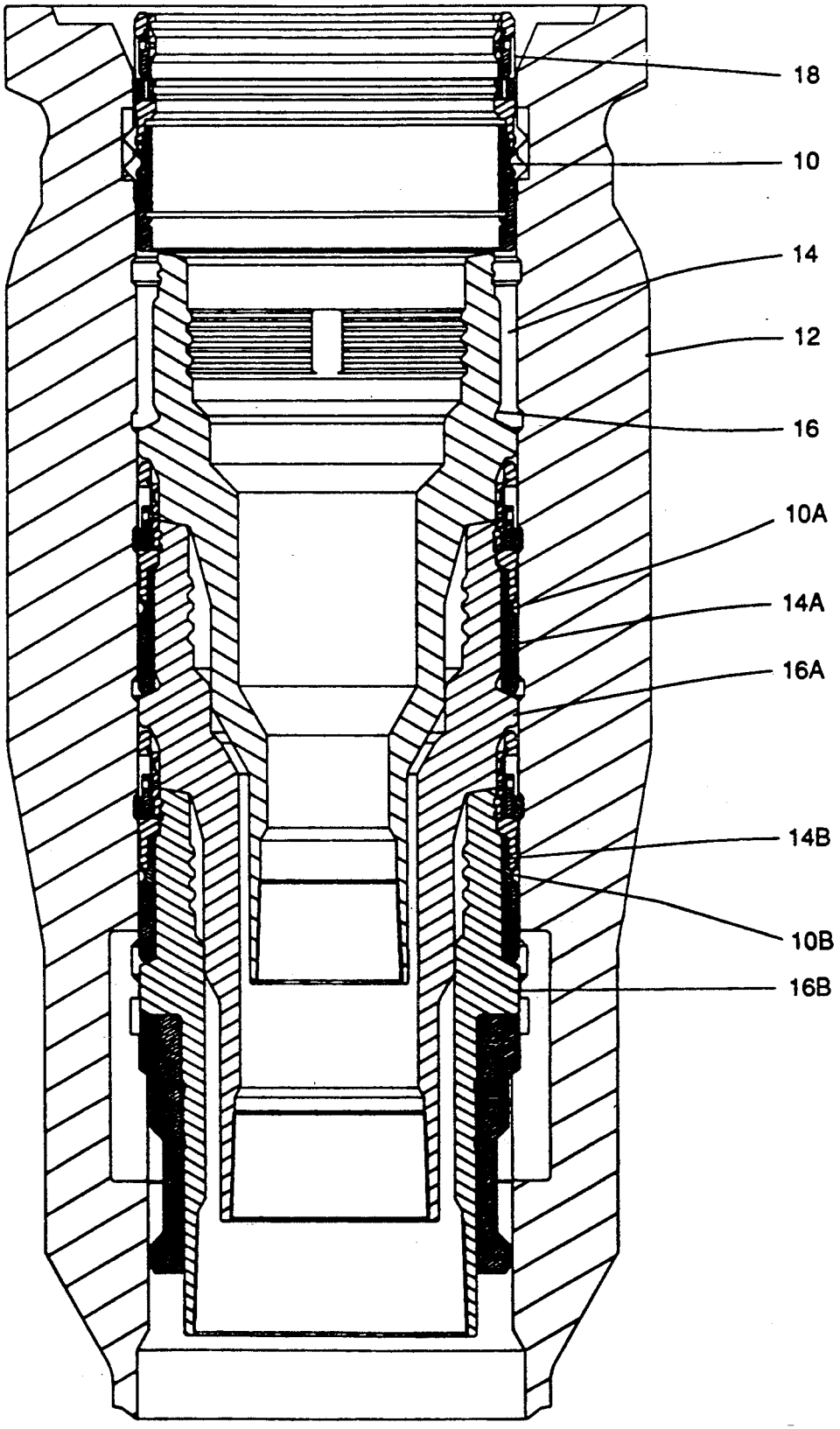
FIG. 1 is a sectional elevation view of a hanger landed within a well housing and the improved seal assembly of the present invention being in position for lowering into sealing position across the annulus between the hanger external sealing surface and the well housing internal sealing surface.

Improved seal assembly 10 of the present invention, as shown in FIG. 1, is illustrated while being lowered within well housing 12 and into annulus 14 between the interior of well housing 12 and the exterior of hanger 16 which has been landed within well housing 12. As shown in FIG. 1, hangers 16A and 16B have previously been landed within housing 12 and their respective seal assemblies 10A and 10B have been landed and energized in the respective annuli 14A and 14B. Seal assembly 10 is supported from setting assembly 18 and setting assembly 18 is supported on a suitable tool (not shown) which can move the setting assembly 18 after landing into its set position as hereinafter described.

Figure 2:
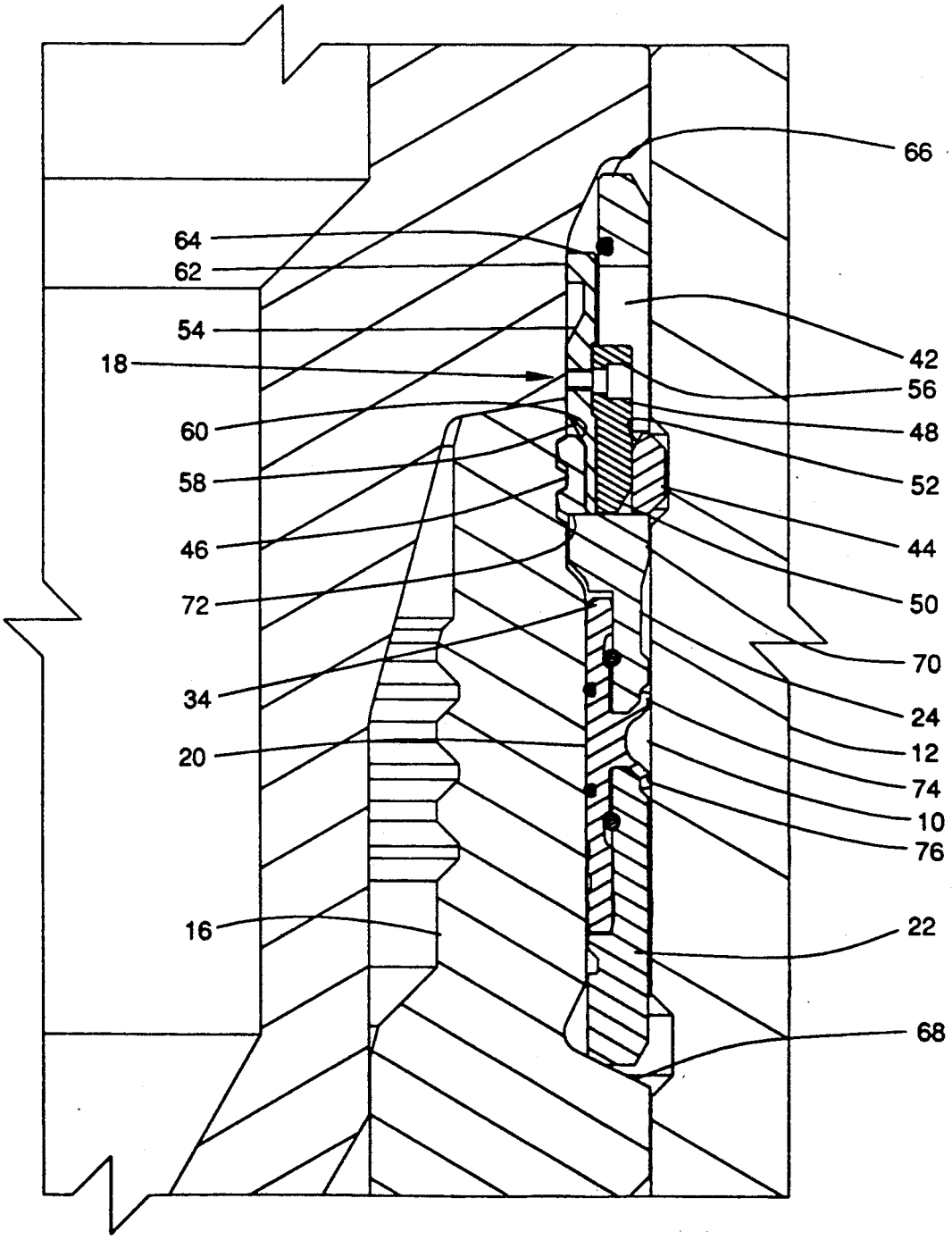
FIG. 2 is a partial sectional view illustrating the seal assembly in its landed and set position in the hanger-housing annulus.
Figure 3:
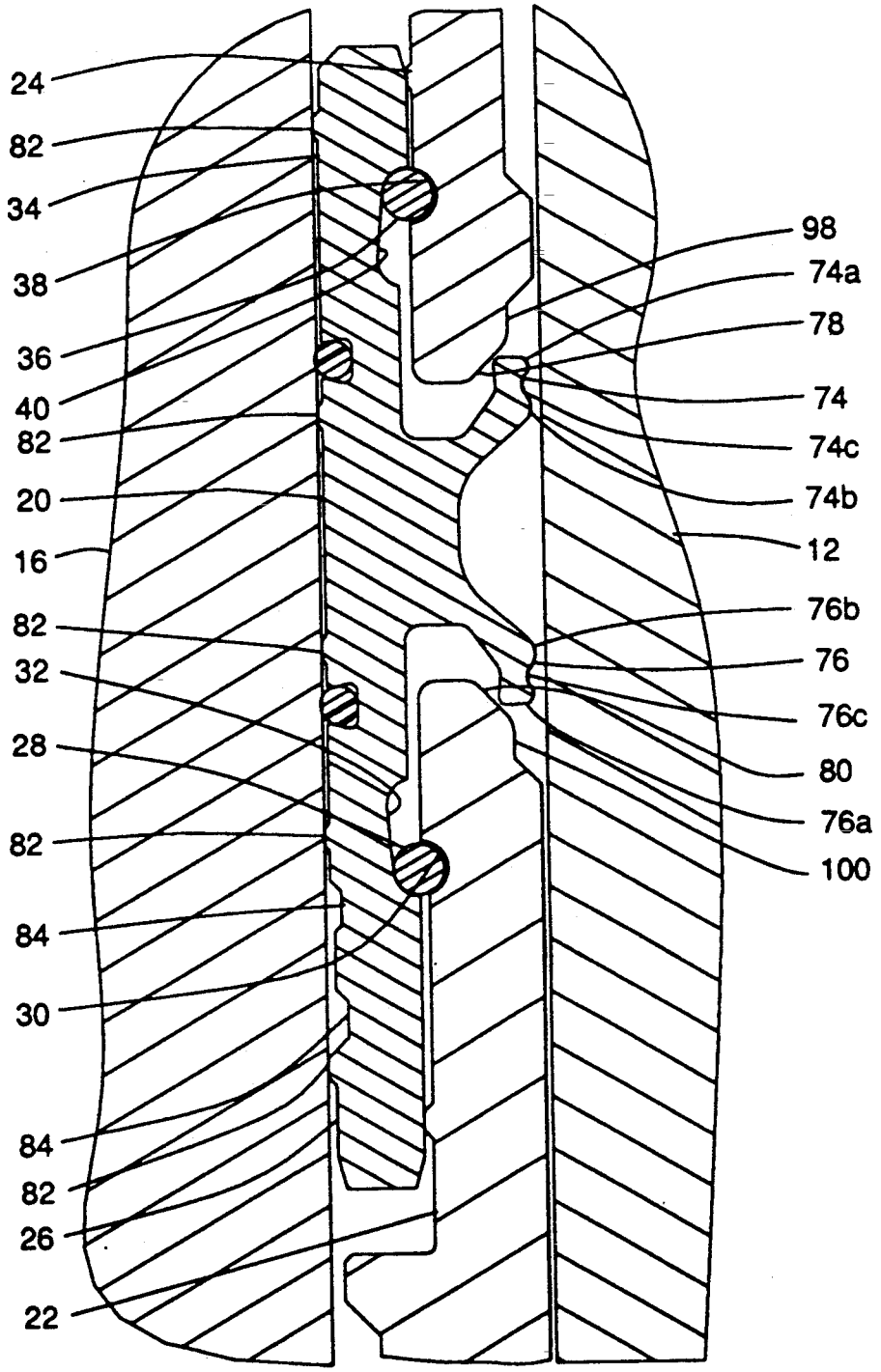
FIG. 3 is a detailed partial sectional view of the seal assembly of the present invention in its unset position.

Seal assembly 10 includes annular body 20, lower energizer ring 22, and upper energizer ring 24 as shown in FIGS. 2 and 3. Lower energizer ring 22 is movably attached to lower rim 26 of body 20 by split ring 28 which is positioned in groove 30 on the interior of energizer ring 22 and in elongated groove 32 in the exterior of lower body rim 26. This allows relative axial movement of energizer ring 22 with respect to body 20. Upper energizer ring 24 is movably attached to upper rim 34 of body 20 by split ring 36 which is positioned in groove 38 on the interior of energizer ring 24 and in elongated groove 40 on the exterior of upper body rim 34. This allows relative axial movement of energizer ring 24 with respect to body 20. Windows 42 are provided in upper energizer ring 24 with exterior latching ring 44 and interior split locking ring 46 positioned around ring 24 and biased inwardly and outwardly respectively. Wedge elements 48 are positioned within windows 42 immediately above exterior latching ring 44 during running and have a lower outer tapered surface 50 which coacts with upper inner tapered surface 52 on exterior latching ring 44. Ring 54 is positioned within energizer rim 66 of ring 24 and is secured by cap screws 56, or other suitable securing means, to wedge elements 48 as shown. Ring 54 includes lower tapered surface 58 which coacts with upper outer tapered surface 60 on split locking ring 46 as hereinafter explained. Ring 54 includes inner flange 62 and upper surface 64 which during running is at approximately the same level as upper surface 66 on upper energizer ring 24.

When seal assembly 10 is landed with the lower end of lower energizer ring 24 on the exterior shoulder 68 provided by hanger 16, setting is accomplished by causing the setting tool to push downwardly on the upper surface 66 of upper energizer ring 24. After setting is complete as hereinafter described, then pushing downwardly on ring 54 causes exterior latching ring 44 to be wedged outwardly into internal housing groove 70 and interior latching ring 46 to be wedged inwardly into hanger groove 72 to lock seal assembly 10 in its landed and set position.

Figure 4:
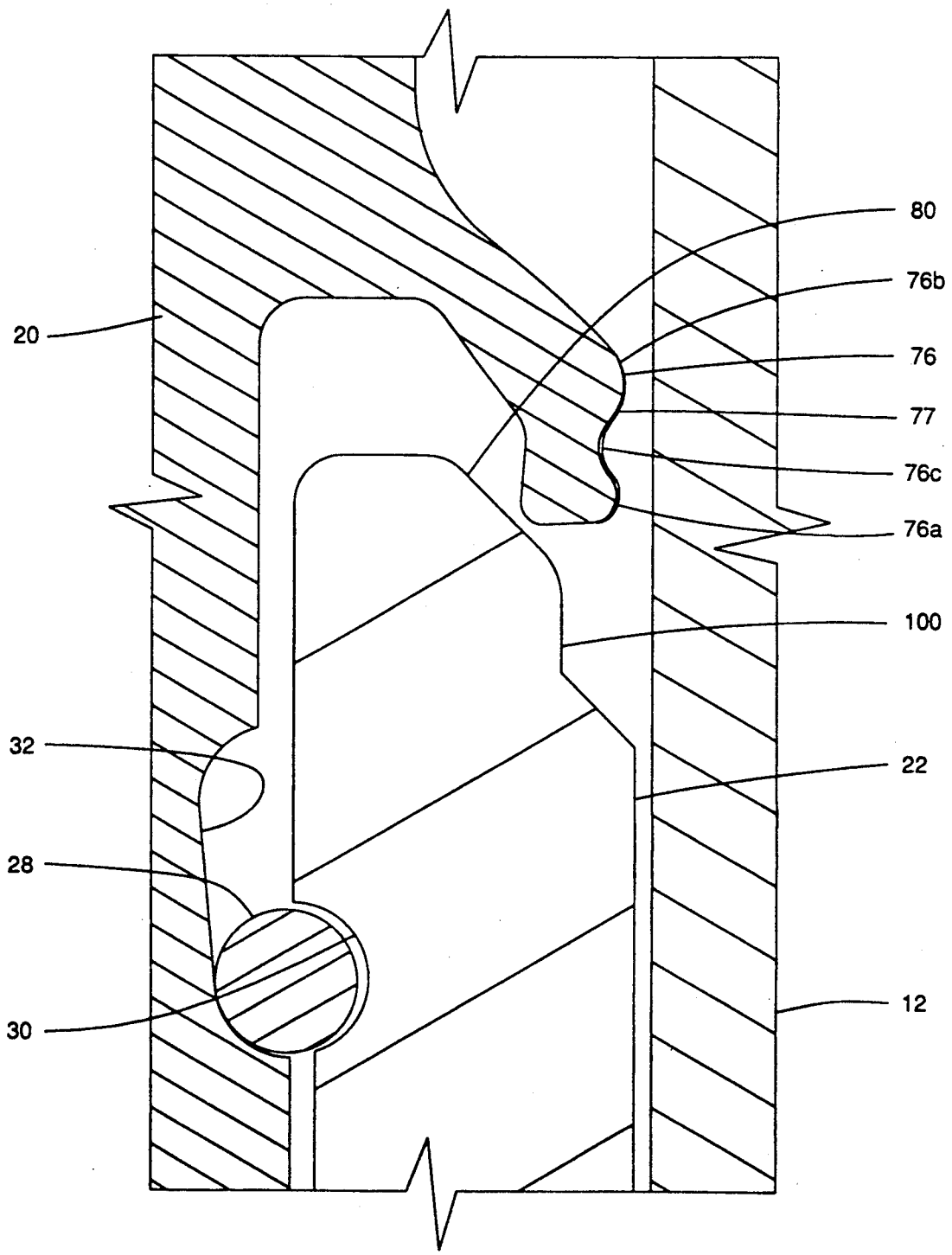
FIG. 4 is a partial enlarged sectional view of the lower seal lip and the energizing ring as shown in FIG. 3.
Figure 5:
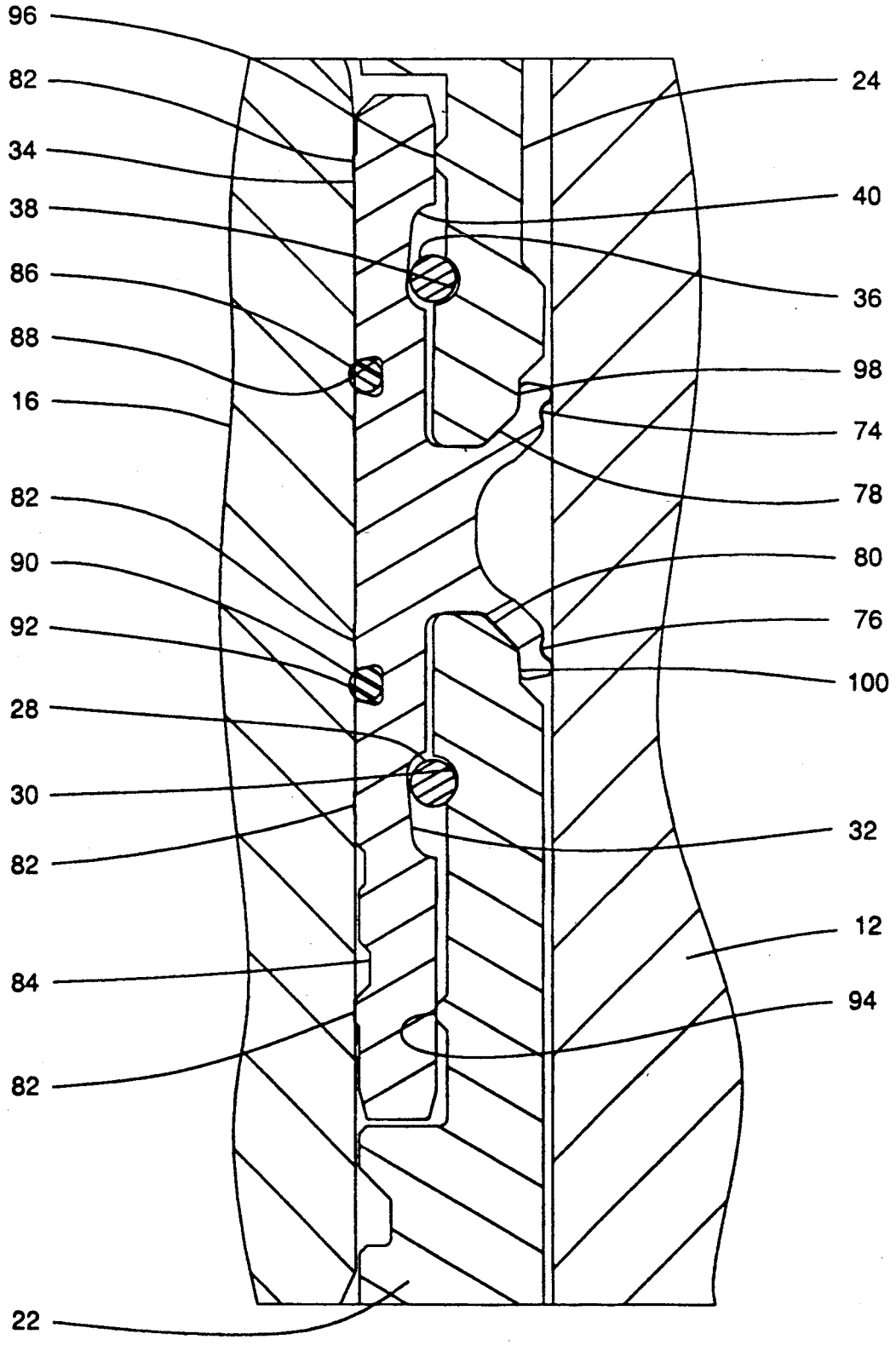
FIG. 5 is a detailed partial sectional view of the seal assembly shown in FIG. 3 after it has been moved to its set position.
Figure 6:
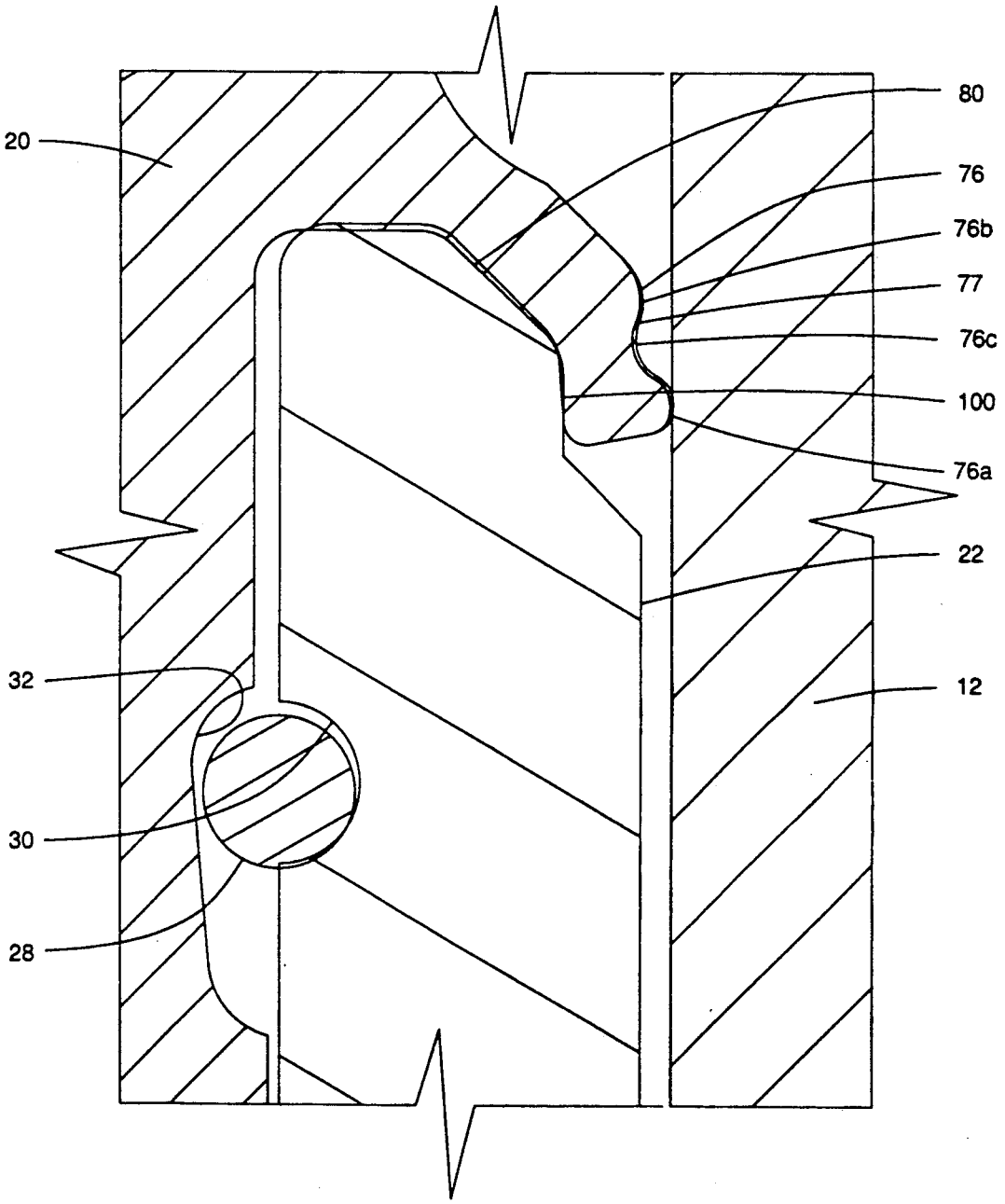
FIG. 6 is a partial enlarged sectional view of the lower seal lip and its energizing ring as shown in FIG. 5.

As shown in FIGS. 3 and 4, seal body 20 includes upper annular lip 74 and lower annular lip 76. Upper annular lip 74 extends outwardly from the exterior of body 20 and then extends upwardly to a generally axial upward position. Lower annular lip 76 extends outwardly from the exterior of body 20 and then extends downwardly to a generally axial downward position. The outer end of lips 74 and 76 include sealing lobes or surfaces 74*a* and 76*a* respectively at the outer extremity thereof as shown and protecting lobes or surfaces 74*b* and 76*b* respectively on the exterior surface of the lips 74 and 76 which extends generally axially and such surfaces 74*b* and 76*b* are spaced from surfaces 74*a* and 76*a* respectively by grooves 74*c* and 76*c* respectively. The diameter of protective surfaces 74*b* and 76*b* are larger in their free position than the outer diameter of sealing surfaces 74*a* and 76*a* as shown in FIGS. 3 and 4. In running position the exterior diameter of surfaces 74*b* and 76*b* is smaller than the inner diameter of housing 12. During running it is hoped that neither the sealing surfaces nor the protecting surfaces will be scratched or damaged by contact with the interior of the well housing 12. In any case even if the protecting surfaces 74*b* and 76*b* are scratched or otherwise damaged, they will have protected sealing surfaces 74*a* and 76*a* from such damage. Further a coating 77 of a scratch healing soft metal is provided on the surfaces 74*a, b* and *c* and 76*a, b* and *c*. This coating is preferred to be with a metal such as silver or lead and a silver plating is preferred. With this coating any scratches on the sealing surfaces 74*a* or 76*a* will not interfere with the sealing engagement of such surfaces with the interior of the well housing 12 as shown in FIGS. 5 and 6. The coating 77 will be sufficiently soft so that when sealing surfaces 74*a* and 76*a* are forced into engagement with the housing interior, the metal of the coating will be sufficiently soft to flow into the scratch and avoid sealing problems.

As best seen in FIG. 5, upper energizer ring 24 has its inner surface spaced slightly outward from the exterior surface of upper rim 34 and a lower tapered surface 78 which engages the inner surface of upper lip 74 during setting to move it radially outward to the set position in metal-to-metal sealing engagement with the interior surface of housing 12. Lower energizer ring 22 has its inner surface spaced slightly outward from the exterior surface of lower rim 26 and an upper tapered surface 80 which engages the inner surface of lower lip 76 during setting to move it radially outward to the set position in metal-to-metal sealing engagement with the interior surface of housing 12.

The present invention uses a high yield strength steel for energizer rings 22 and 24 and uses a lower yield strength steel for upper and lower lips 74 and 76. This allows lips 74 and 76 to have sufficient malleability when forced against the interior of housing 12 to flow into the flaws and irregularities of such surface and ensure that there is complete metal-to-metal sealing. With the high yield strength energizer rings 22 and 24, they are subjected to a slight inward elastic deflection at their extremities as shown in FIG. 6. This effectively stores the setting forces to ensure continued sealing of lips 74 and 76 against the interior of housing 12.

As best seen in FIG. 5, the interior of body 20 includes a series of annular ridges 82 separated by grooves 84. The inner diameters of ridges 82 are smaller than the diameter of the exterior portion of hanger 16 against which seal body 20 is to engage and seal. Care should be taken with the depth of grooves 84 to avoid problems with the build-up of pressure in liquids trapped therein during setting so that the sealing loads of the ridges 82 are not reduced thereby. It is preferred that if the groove 84 have a radial dimension of approximately 0.005" a water exclusion material or a volume compensating material should be provided in grooves 84 so that the water pressure developed therein does not interfere or lessen the sealing load of the ridges 82 against the exterior surface of hanger 16. If there is some objection to the use of such materials, then it is suggested that the depth of grooves 84 be at least 0.040". This depth of grooves 84 is selected so that the compressibility of the volume of trapped fluid due to its bulk modulus is sufficient to prevent excessive pressure build-up due to flexing of the metal seal. Upper resilient sealing ring 86 is positioned in upper groove 88 and lower resilient sealing ring 90 is positioned in lower groove 92. Sealing rings 86 and 90 provide supplemental sealing between the interior of seal body 20 and the exterior of hanger 16.

It should be noted that in order to ensure engagement of the ridges 82 with the exterior portion of hanger 16 the interior portions of energizer rings 22 and 24 are provided with inwardly extending projections 94 and 96, respectively, which are positioned immediately outside of lower and upper ridges 82 when seal assembly 10 is set as shown in FIG. 5. Projections 94 and 96 have a radial dimension which ensures that upper and lower ridges 82 are in sealing engagement with the exterior portion of hanger 16.

With the configuration of the wedging ends of energizer rings 22 and 24 the forces exerted on sealing lips 74 and 76 are exerted by the axially extending surfaces 98 and 100. This causes only radial forces to be exerted on lips 74 and 76 so that there is no axial force tending to urge the energizer rings axially away from the sealing lips.

What is claimed is:

1. A sealing assembly for sealing between an interior sealing surface of a well housing and an exterior sealing surface of a hanger landed within the well housing comprising an annular seal body having an outer seal lip which extends in a generally radial direction from said seal body, and a plurality of inner ridges, said outer seal lip having both a first sealing surface and a second protecting surface with the second protecting surface having a larger free diameter than the diameter of the first sealing surface whereby any engagement with the interior sealing surface of the well housing during running is by the second protecting surface and the first sealing surface is protected from being scratched or otherwise damaged by such contact, energizing means for engaging the outer seal lip and urging it outwardly to position said first sealing surface in sealing engagement with the interior sealing surface of the housing.

2. A sealing assembly according to claim 1 wherein said outer seal lip having an outer surface, a point of connection to said annular seal body and an outer end, said first sealing surface is a rounded surface on the outer end of said outer seal lip and said second protecting surface is a rounded surface on the outer surface spaced from the first sealing surface toward the point of connection of said outer seal lip to said annular seal body.

3. A sealing assembly according to claim 1 including a coating of a soft scratch healing metal material on said first sealing surface and said second protecting surface and the outer surface of said outer seal lip between said surfaces.

4. A sealing assembly according to claim 3 wherein said coating is silver.

5. A sealing assembly according to claim 1 wherein said inner ridges having grooves therebetween and an inner diameter which is smaller than the outer diameter of the hanger sealing surface.

6. A sealing assembly according to claim 5 including means for preventing excessive pressures being generated in liquids trapped in the grooves between the ridges.

7. A sealing assembly according to claim 6 wherein said excess pressure prevention means includes a water exclusion material in said grooves.

8. A sealing assembly according to claim 6 wherein said excess pressure prevention means includes having the depth of the grooves between the ridges being at least 0.040 inches.

9. A sealing assembly according to claim 6 wherein said energizing means includes means for preventing its retraction from its setting engagement with said seal lip.

10. A sealing assembly according to claim 1 wherein said energizing means includes an annular body, and a wedge engaging said seal lip.

11. A sealing assembly for sealing between the interior sealing surface of a well housing and the exterior sealing surface of a hanger landed within the well housing comprising an annular seal body having an outer upper seal lip and an outer lower seal lip, each of which extends in a generally radial direction from said seal body, said outer upper seal lip and said outer lower seal lip each having both a first sealing surface and a second protecting surface with the second protecting surface having a larger free diameter than the diameter of the first sealing surface whereby any engagement with the interior of the well housing during running is by the second protecting surface and the first sealing surface is protected from being scratched or otherwise damaged by such contact, an upper energizing means for engaging the upper seal lip and urging it outwardly to move said first sealing surface on said upper seal lip into sealing engagement with the sealing surface of the housing, and a lower energizing means for engaging the lower seal lip and urging it outwardly to move said first sealing surface on said lower seal lip into sealing engagement with the sealing surface of the housing.

12. A sealing assembly according to claim 11 wherein said first sealing surface on each of said lips is a rounded surface on the outer end of said lips and said second protecting surface on each of said lips is a rounded surface on the outer surface spaced from the first sealing surface toward the point of connection of said lips to said annular seal body.

13. A sealing assembly according to claim 11 including a coating of a soft scratch healing metal on each of said first sealing surfaces and said second protecting surfaces and the surface of said lips between said surfaces.

14. A sealing assembly according to claim 13 wherein said coating is silver.

* * * * *